US006831564B2

(12) United States Patent
Bair, III et al.

(10) Patent No.: US 6,831,564 B2
(45) Date of Patent: Dec. 14, 2004

(54) LOW SUPPLY TANK PRESSURE WARNING

(75) Inventors: Richard H. Bair, III, Weaverville, NC (US); Bryan M. Elwood, Candler, NC (US)

(73) Assignee: Kendro Laboratory Products, Inc., Asheville, NC (US)

( * ) Notice: Subject to any disclaimer, the term of this patent is extended or adjusted under 35 U.S.C. 154(b) by 0 days.

(21) Appl. No.: 10/166,174

(22) Filed: Jun. 11, 2002

(65) Prior Publication Data

US 2003/0227388 A1 Dec. 11, 2003

(51) Int. Cl.[7] ..... G08B 21/00

(52) U.S. Cl. ..... 340/626; 340/632; 73/23.2; 73/37; 137/14

(58) Field of Search ..... 340/626, 605, 340/606, 632, 611, 286.05; 137/557, 89, 14; 73/40.5 R, 861.19, 196, 37, 23.2, 23.27, 23.29; 123/529, 198 D; 128/204.18, 204.19, 205.23

(56) References Cited

U.S. PATENT DOCUMENTS 4,100,537 A * 7/1978 Carlson ..... 340/626
4,650,766 A 3/1987 Harm et al. ..... 435/284
4,892,830 A 1/1990 Findley et al. ..... 435/290
5,542,287 A * 8/1996 Powers ..... 73/40.5 R
5,595,189 A * 1/1997 Naim et al. ..... 128/774
5,882,384 A * 3/1999 Tom et al. ..... 96/111
5,999,106 A * 12/1999 Buckler ..... 340/870.09
6,067,022 A * 5/2000 Laswick et al. ..... 340/626
6,125,846 A * 10/2000 Bathe et al. ..... 128/202.22
6,137,417 A * 10/2000 McDermott ..... 340/626
6,180,397 B1 1/2001 Binder ..... 435/303.1
6,265,210 B1 7/2001 Silley et al. ..... 435/303.1
6,406,519 B1 * 6/2002 Tom et al. ..... 95/95
6,467,466 B1 * 10/2002 Mackawa et al. ..... 123/529
6,536,456 B2 * 3/2003 Dickerson, Jr. et al. ..... 137/12

* cited by examiner

*Primary Examiner*—Davetta W. Goins
(74) *Attorney, Agent, or Firm*—Baker & Hostetler LLP

(57) ABSTRACT

An apparatus for notifying a user when the gas pressure of a gas is at or below a threshold pressure. The gas can be injected into a chamber of an incubator. The gas pressure can be measured, relayed and compared to the threshold pressure. If the gas pressure is at or below the threshold pressure, the user will be notified that the gas pressure needs to be corrected.

8 Claims, 2 Drawing Sheets

LOW SUPPLY TANK PRESSURE WARNING

FIELD OF THE INVENTION

Embodiments of the present invention generally relate to an apparatus and method for use with a controlled gas atmosphere. More particularly, the apparatus and method of the present invention relates to notifying a user when the gas pressure is at or below a threshold pressure in an incubator.

BACKGROUND OF THE INVENTION

There are a number of commercial applications that utilize a controlled gas atmosphere enclosure. For example, in the semiconductor industry, gases are injected into an enclosed chamber wherein one of the gases is plasmarized and hits a target on a chamber lid causing the target's materials to deposit on a wafer. Other commercial applications include using controlled gases to cultivate biological cultures in an enclosed chamber such as an incubator. It is desirable to maintain optimal conditions inside the incubator in order to promote the desired growth of the cultures. In a conventional incubator, gases such as $O_2$, $N_2$, and $CO_2$ are introduced from their respective tanks into the chamber depending on the growing conditions desired. Typically, the user sets the $CO_2$ and $O_2$ setpoints and the appropriate gases are added. $N_2$ can be used to purge excess $O_2$ from the incubator when the $O_2$ level in the chamber is too high for the setpoints.

A conventional incubator is generally rectangular and has up to five insulated walls (top, bottom, left side, right side, and rear). Each wall may have an inner space defined by the inner and outer surfaces of the insulated wall and the inner spaces are in communication with each other. An insulated front door together with the insulated walls completes the inner chamber of the incubator. The door is typically mounted on hinges on the front side of one of the sidewalls. The door allows access into the inner chamber where culture plates are placed or removed from the shelves provided therein.

Most biological incubators are either water jacket or forced draft. In the water jacket incubator, a water jacket is inserted in the inner space of the incubator. A heater is used to heat the water in the water jacket to the desired temperature. Because water can be heated evenly, the water jacket can evenly distribute the desired heat throughout the inner chamber. Such even heating is desired in order to provide a uniform temperature (for the biological cultures) throughout the chamber and to prevent "cold spots," which can cause condensation on the inner chamber walls.

Although heating of the chamber walls in the water jacket incubator is substantially uniform, the chamber atmosphere can stratify thermally if the chamber atmosphere is undisturbed. Due to the stratification, the temperature of the chamber is greater at the top of the chamber than at the bottom of the chamber. Therefore, it is desirable to maintain a certain flow rate of constituent gases within the chamber to assure uniformity of the temperature. The pressure set by the user on the constituent gas tanks contributes to the flow of the gases, and thus, needs to be monitored.

For proper culture growth, it is desirable to maintain certain pressure levels and flow rates of $N_2$, $CO_2$, and $O_2$ in the chamber. Rapid recovery of these gas concentrations are of significant importance for proper cell growth. Wide ranges of gas inlet pressure can be troublesome and hinder gas concentration recovery efforts, thus monitoring this pressure is critical. Deterministic flow rate(s) offer the capability for a system to optimize its gas concentration recovery. If a flow of gas is less than 10 psig, then control algorithms cannot adequately recover using a linear model of flow injection. Furthermore, if gas inlet pressure(s) exceed 30 psig, the system integrity is at risk. Once an orifice with a set diameter and the specific gravity of the particular gas being injected are known, then flow rates can be accurately predicted with the exceptions aforementioned; i.e., at low pressures flow rate prediction becomes much more complex and at high pressures component specification failures can occur. Typically, the user sets the pressure of the gas being injected by turning a lever on the tank until the gauge on the tank reads around 15 psig or the desired pressure. However, the pressure that actually flows into the incubator can vary as much as ±15 psig. The user can set the pressure, but can not be certain as to how much pressure is actually flowing through the orifice due to possible errors in the gauge of the tanks, the orifice and the gas line being clogged, or other factors that can affect the gas pressure and flow rate. At pressures between 15 to 30 psig, flow variations are essentially linear, and are easy to compensate. In the range of 10 to 15 psig, variations are more non-linear, but the errors can still be acceptable. Below 10 psig, other factors such as viscosity and surface tension will make the errors in the flow rate and pressure unacceptable. Once the error becomes unacceptable, then the results of the culture being grown in the incubator will be affected destroying months to years of research. Thus, it is important to know if the pressure level is at or below 10 psig or a predetermined level that is independent of the gauge on the tanks, so that action can be taken by the user to increase the pressure.

Therefore, there is a need for a notification system to allow a user to know when the pressure of the gas is at or below a predetermined threshold level in the incubator for improved culture growth.

SUMMARY OF THE INVENTION

The present invention generally relates to a notification system to allow a user to know when the pressures at the gas inlets of the incubator are below a predetermined level. The notification system helps to ensure that the incubator is operating at the desired pressure for optimal growth of the cultures.

One embodiment of the present invention can include a notification apparatus for an enclosed chamber that includes a threshold pressure setter that can set a threshold pressure for a gas, a gas pressure evaluator that may determine the gas pressure of the gas, a gas pressure comparator that may compare the gas pressure and the threshold pressure, and an indicator that can indicate when the gas pressure reaches the threshold pressure, wherein the setter, evaluator, and indicator can be in communication with each other. The threshold pressure can be about 10 psig or less and the gas pressure evaluator can be a transducer. The gas pressure comparator can compare the gas pressure relayed by a transducer with the threshold pressure and can communicate with the indicator when the threshold pressure is reached. The transducer can relay the gas pressure to the comparator via a wire or a wireless means. The indicator can indicate visually and/or audibly. The can notify a user that the pressure of the gas is at or below the threshold pressure.

Another embodiment of the invention can include a method of notifying a user of a gas pressure and can include setting a threshold pressure of an injected gas, evaluating a current gas pressure of the gas with the threshold pressure of the gas, and displaying a result to the user. The method further includes injecting the gas at a predetermined pressure. Setting the threshold pressure can be done via a user interface. Evaluating the current gas pressure with the threshold pressure to determine if the current gas pressure is at or below the threshold pressure. A transducer can be used to relay the current gas pressure to a controller and displaying the result can include informing the user when the current gas pressure is at or below the threshold pressure.

In another embodiment of the invention a notification system for an enclosed chamber that includes a means for setting a threshold pressure of a gas; a means for evaluating a pressure of the gas, a means for comparing the gas pressure and the threshold pressure, and a means for indicating a result to the user. The means for setting can be a user interface and the gas can be selected from a group consisting of $CO_2$, $O_2$, and $N_2$. The means for evaluating the pressure of the gas may be a transducer means. Additionally, the means for comparing can compare whether the gas pressure is at or below the threshold pressure and the means for indicating can notify the user when the gas pressure is at or below the threshold pressure.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

The present invention notifies a user when the pressures of a gas or gases are below a predetermined threshold pressure. By notifying the user that the pressure is at or below the predetermined threshold pressure, the user can respond and increase the pressure, thereby preventing damage to the samples in the incubator. "Notify" as used herein can be visual, audible or other means, so long as, the user knows which pressure level of which tank(s) is below the predetermined threshold pressure. Notification can occur at the incubator via an integrated display or remotely such as another display, fax, email, phone, computer or any means that will allow the user to know which pressure of which tank(s) are at or below the predetermined threshold pressure. The transducers described herein can be located anywhere (between the hose and the inlet or embedded in the inlet) near or in the inlet, as long as it can monitor the pressure of the gas at the gas inlet. The transducer can be the MPX5050GP™ from Motorola (Austin, Tex.).

Figure 1:
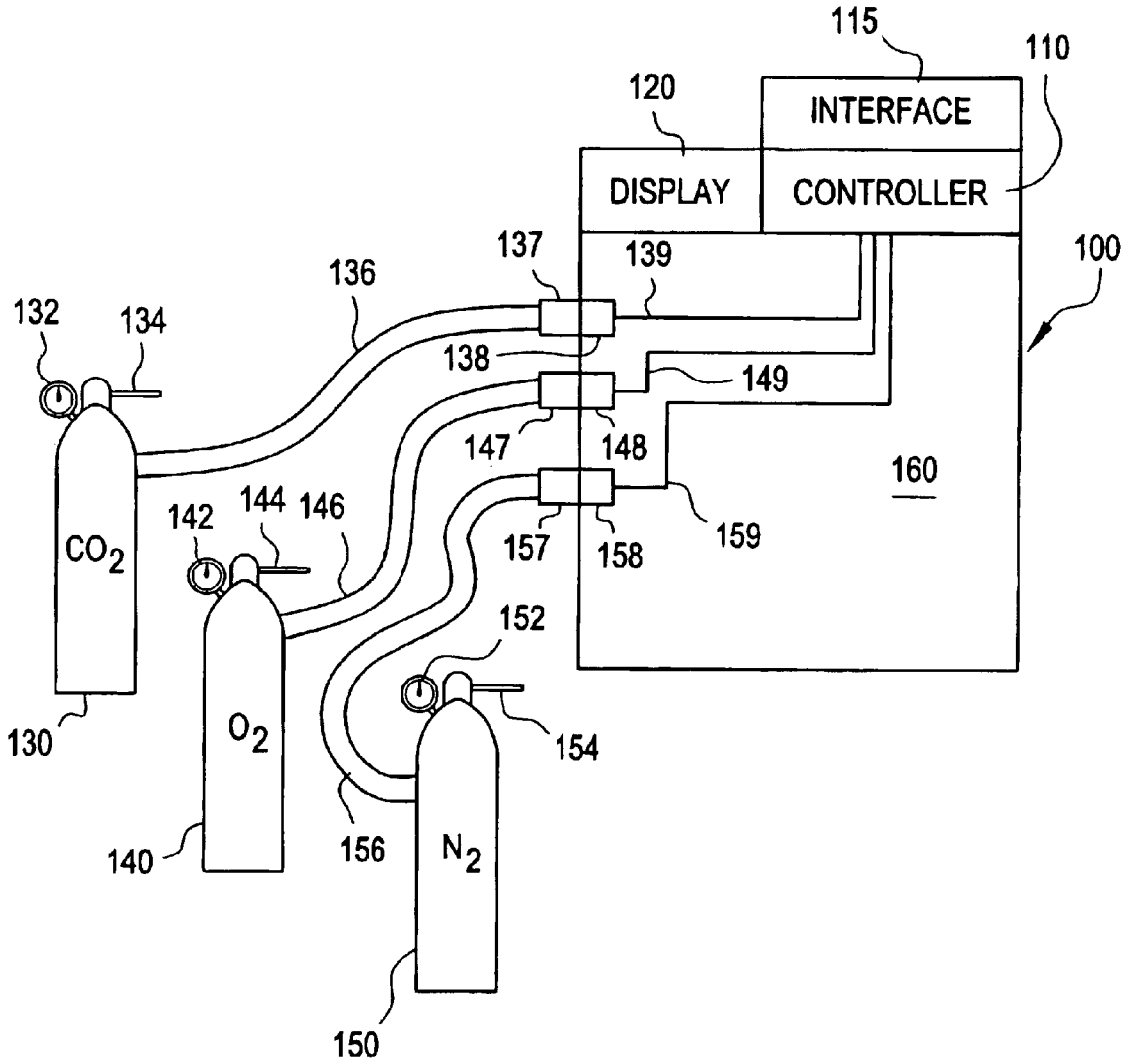
FIG. 1 is one embodiment of an apparatus of the present invention.

FIG. 1 is one embodiment of an apparatus of the present invention. An incubator 100 having a chamber 160, a controller 110, an interface 115, a display 120 and connected to various gas tanks such as a $CO_2$ tank 130, an $O_2$ tank 140 and a $N_2$ tank 150. The samples can be placed on shelves of the chamber 160 and gases can be introduced at certain pressures from tanks 130, 140, 150 into the chamber in order to control the atmosphere of the chamber. The controller 110 can be embedded in the incubator 100 or can be remotely located, such as in a computer. The controller 110 can monitor the pressure through a transducer 138, 148, 158, which can relay data via a relay line 139, 149, 159. The controller 110 can monitor as many gases as desired via the transducer. The controller 110 is in communication with the display 120 and the interface 115. The display 120 can be audible and/or visual and can also be remotely located. The display 120 can notify the user when the pressure of the gas is at or below a certain threshold pressure. The user can use the interface 115 to set the threshold pressure for each gas that will be injected into the chamber 160. The gas tanks 130, 140, and 150 can contain $CO_2$, $O_2$, and $N_2$, respectively and are typically used in a tri-gas incubator. However, any gas can be used with the present invention.

The $CO_2$ tank 130 includes a first pressure dial 132, a first handle 134 and a first gas hose 136. The first pressure dial 132 displays the current pressure that is suppose go into the first gas hose 136 and the current pressure can be set by adjusting the first handle 134 in a first direction (to increase the pressure) or in a second direction (to decrease the pressure). The $CO_2$ gas can travel in the first gas hose 136 to a first gas inlet 137. The first gas inlet 137 allows the $CO_2$ gas to flow into the chamber 160. A first pressure transducer 138 can be located at an end of the first gas inlet 137 where the gas enters the chamber 160. The first gas transducer 138 can monitor the gas pressure from the first gas inlet 137 and relay the data via a relay line 139 to the controller 110. The transducers 138, 148, 158 can have a self-contained power source or may receive power from the relay line 139 or other sources. The transducers 138, 148, 158 can also communicate with the controller 110 via a wireless means that is known in the art.

The gas pressure can be set by the user, however, errors can occur if the pressure is not monitored at the gas inlet. For example, the pressure can be set by the user via the first handle 134, however, if the user is not paying attention, he can set the pressure below the threshold pressure of the gas. The first gauge 132 can malfunction and thus, a gauge needle of the first gauge can display the incorrect pressure, leading the user to believe that the correct pressure was set. Other errors can occur if the first gas hose 136 and/or the first gas inlet 137 are obstructed by artifacts or if the tanks are daisy chained, causing the pressure to fluctuate from the desired settings. By having the first transducer 138 and the other transducers 148, 158 monitor the gas pressure that actually enters the chamber 160, a more accurate measurement can be made leading to better prevention of the gas pressure from falling below the threshold pressure. Additionally, because the user can be notified instantly when the pressure of the gas is below a certain threshold pressure, the user can take the appropriate measure to bring the gas pressure to or above the threshold pressure. Because the user can correct the gas pressure almost immediately, the non-linear problems that are associated with having a gas pressure below the threshold pressure can be avoided, leading to better overall results for the user.

Still referring to FIG. 1, the $O_2$ tank 140 can include a second pressure dial 142 and a second handle 144. The user can turn the second handle 144 to allow the $O_2$ gas to flow into a second gas hose 146. The second gas hose 146 can be attached to second gas inlet 147, which can have a second pressure transducer 148 near or in the inlet to monitor the $O_2$ gas pressure flowing into the chamber 160. The $N_2$ tank 150 can include a third pressure dial 152 and a third handle 154. The user can turn the third handle 154 to allow the $N_2$ gas to flow into the third gas hose 156. The third gas hose 156 can be attached to a third gas inlet 157, which can have a third pressure transducer 158 near or in the inlet to monitor the $N_2$ gas pressure flowing into the chamber 160.

Figure 2:
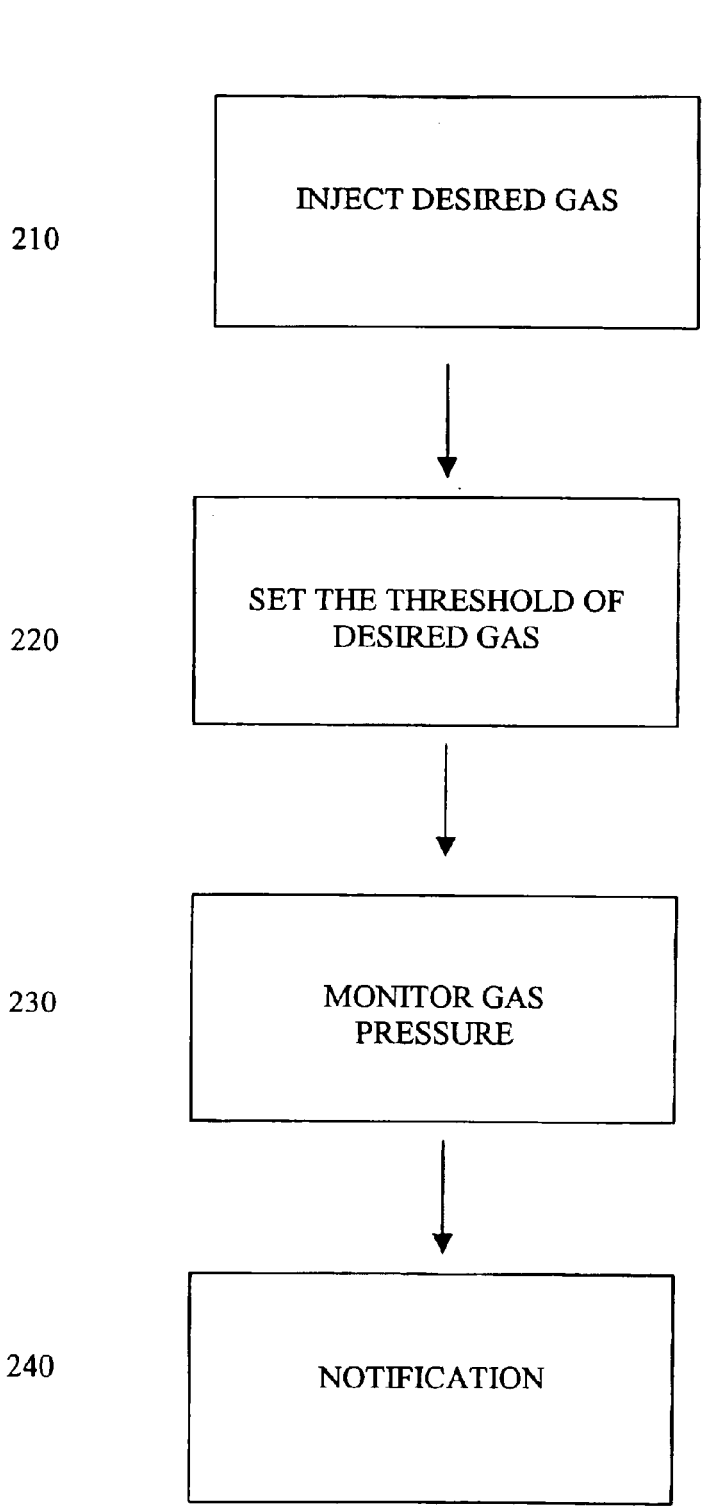
FIG. 2 is a flowchart of an embodiment of the present invention.

FIG. 2 is a flowchart 200 of an embodiment of the present invention. The flow chart 200 starts at step 210, where the desired gas is injected into the chamber 160. The gas may be $O_2$, $CO_2$, $N_2$ or any gas that is desired. Typically, the user can select the appropriate gas via the interface 115. At step 220, the user can also set the threshold pressure for the selected gas via the interface 115. The threshold pressure can be any pressure level that the user desires, such as between 0 psig to 40 psig, preferably between 11 to 20 psig, and more preferably around 5 to 10 psig. The threshold pressure can be the pressure that the user should be notified when the selected gas pressure is at or below the set level. At step 230, the transducer 138, 148, 158 along with the controller 110 can monitor the respective gas pressure, and let the user know when the respective gas pressure is at or below the threshold pressure for the respective gas. At step 240, when the gas pressure reaches or is below the threshold pressure, notification of the user will occur. Notification can occur at the display 120 which can be located at the incubator 100 or can occur at a remote location. The notification can be visual and/or audible so long as the user is notified that pressure of the gas is at or below the threshold pressure of the gas. This will allow the user to take any measures desired. Some examples can include, the user replacing the gas tank because it out of gas, the user can increase the pressure by turning a handle or any other measure the user desires.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A notification apparatus for an enclosed chamber, comprising:

a plurality of gas injectors connected to said chamber;

an interface to set a threshold pressure for a gas connected to a controller;

a gas pressure evaluator in communication with said gas injectors, wherein the evaluator determines the gas pressure of the gas at said gas injectors;

a gas pressure comparator that compares the gas pressure and the threshold pressure; and an indicator that shows when the gas pressure reaches the threshold pressure, wherein the evaluator, comparator, and indicator are in communication with each other via the controller.

2. The notification apparatus of claim 1, wherein the threshold pressure is about 10 psig or less.

3. The notification apparatus of claim 1, wherein the gas pressure evaluator is a transducer.

4. The notification apparatus of claim 1, wherein the gas pressure comparator compares the gas pressure relayed by a transducer with the threshold pressure and communicates with the indicator and shows when the gas pressure is at or below the threshold pressure.

5. The notification apparatus of claim 3, wherein the transducer relays the gas pressure to the comparator via a wire or a wireless means.

6. The notification apparatus of claim 1, wherein the indicator indicates visually.

7. The notification apparatus of claim 1, wherein the indicator indicates audibly.

8. The notification apparatus of claim 1, wherein the indicator notifies a user that the pressure of the gas is at or below the threshold pressure.

* * * * *